US009833662B2

(12) United States Patent
Potter et al.

(10) Patent No.: US 9,833,662 B2
(45) Date of Patent: Dec. 5, 2017

(54) SERIES ELASTIC MOTORIZED EXERCISE MACHINE

(71) Applicant: Rethink Motion Inc., Houston, TX (US)

(72) Inventors: Elliott Potter, Friendswood, TX (US); Aaron Hulse, League City, TX (US)

(73) Assignee: Rethink Motion, Inc., Houston ( * ) Notice: Subject to any disclaimer, the term of this patent is extended or adjusted under 35 U.S.C. 154(b) by 0 days.

(21) Appl. No.: 14/691,702

(22) Filed: Apr. 21, 2015

(65) Prior Publication Data

US 2016/0101322 A1 Apr. 14, 2016

Related U.S. Application Data

(60) Provisional application No. 62/061,815, filed on Oct. 9, 2014, provisional application No. 62/099,191, filed on Jan. 1, 2015.

(51) Int. Cl.
*A63B 24/00* (2006.01)
*A63B 21/00* (2006.01)
(Continued)

(52) U.S. Cl.
CPC ..... *A63B 24/0087* (2013.01); *A63B 21/002* (2013.01); *A63B 21/0058* (2013.01);
(Continued)

(58) Field of Classification Search
CPC . A63B 21/0058; A63B 24/0087; A63B 24/00; A63B 22/0605; A63B 2024/0093;
(Continued)

(56) References Cited

U.S. PATENT DOCUMENTS 3,848,467 A * 11/1974 Flavell ..... A61B 5/22 482/4
3,859,840 A * 1/1975 Gause ..... A61B 5/221 482/4
(Continued)

FOREIGN PATENT DOCUMENTS

EP 1933948 6/2008

OTHER PUBLICATIONS

International Searching Authority, PCT Search Report, Mar. 16, 2016, 1-10, Commissioner of Patents, Alexandria, Virginia, USA.
(Continued)

*Primary Examiner* — Andrew S Lo
(74) *Attorney, Agent, or Firm* — David McEwing

(57) ABSTRACT

The disclosure teaches a novel exercise apparatus. This apparatus does not generate load momentum. The apparatus is based around a series elastic torque sensor and contains an intelligent servo drive with reduction gear to control a variable speed rotating motor shaft. The combination of the motor, gear reducer, spring, angle measurement sensors (position sensors), and intelligent motor controller is a series elastic actuator which is the basis for the exercise device. The exercise device also contains a load transfer mechanism adopted to provide an interface between an individual and the torque sensor. The apparatus allows for isokinetic, isometric, isotonic, and variable force modes of exercise without hardware configuration.

19 Claims, 10 Drawing Sheets

(51) Int. Cl.

| | |
|---|---|
| ***A63B 21/002*** | (2006.01) |
| ***A63B 21/005*** | (2006.01) |
| *A63B 71/06* | (2006.01) |
| *A63B 21/02* | (2006.01) |

(52) U.S. Cl.
CPC ..... *A63B 21/00076* (2013.01); *A63B 21/023* (2013.01); *A63B 21/154* (2013.01); *A63B 2071/0694* (2013.01); *A63B 2220/10* (2013.01); *A63B 2220/51* (2013.01); *A63B 2220/54* (2013.01); *A63B 2220/805* (2013.01)

(58) Field of Classification Search
CPC ..... A63B 21/225; A63B 2220/30; A63B 2220/51; A63B 2220/13; A63B 2220/54; A63B 2220/833; A63B 2230/062; A63B 22/025; A63B 2220/16
USPC ..... 482/1, 5–6
See application file for complete search history.

(56) References Cited

U.S. PATENT DOCUMENTS 4,235,437 A 11/1980 Ruis
4,569,518 A 2/1986 Fulks
4,711,450 A 12/1987 McArthur
4,778,175 A 10/1988 Wucherpfennig
4,811,946 A 3/1989 Pelczar
4,828,257 A 5/1989 Dyer
4,865,315 A * 9/1989 Paterson ..... A63B 21/00178 482/113
4,930,770 A 6/1990 Baker
5,020,794 A 6/1991 Englehardt
5,117,170 A 5/1992 Keane
5,597,373 A * 1/1997 Bond ..... A63B 21/00178 482/1
5,650,704 A * 7/1997 Pratt ..... B25J 9/10 318/560
5,697,869 A 12/1997 Ehrenfried
5,738,611 A 4/1998 Ehrenfried
5,919,115 A 7/1999 Horowitz
5,993,356 A 11/1999 Houston
6,138,520 A * 10/2000 Chang ..... G01L 3/1435 343/753
8,287,434 B2 * 10/2012 Zavadsky ..... A63B 21/00 482/1
8,291,788 B2 10/2012 Ihrke
8,968,155 B2 3/2015 Bird
9,101,791 B2 * 8/2015 Boyette ..... A63B 24/0075
2007/0004567 A1 * 1/2007 Shetty ..... A61H 3/008 482/69
2008/0287268 A1 * 11/2008 Hidler ..... A61H 3/008 482/69
2010/0228441 A1 * 9/2010 Watanabe ..... B62D 5/0457 701/41
2011/0087411 A1 * 4/2011 Fuller ..... F16H 61/6648 701/61
2012/0053014 A1 3/2012 Zhu
2012/0153875 A1 * 6/2012 Glaister ..... A61F 2/66 318/9
2012/0312114 A1 * 12/2012 Deegan ..... F16H 57/12 74/409
2014/0038777 A1 * 2/2014 Bird ..... A63B 21/0058 482/5
2014/0287876 A1 * 9/2014 Etter ..... A63B 24/0087 482/5
2015/0051519 A1 * 2/2015 Morbi ..... A61H 3/04 601/26
2015/0272809 A1 10/2015 Accoto

OTHER PUBLICATIONS

International Searching Authority, PCT Search Report, Apr. 21, 2016, 1-14, Commissioner of Patents, Alexandria, Virginia, USA.
International Searching Authority, PCT Search Report, Jan. 20, 2016, 1-10, Commissioner of Patents, Alexandria, Virginia.
Futek Advanced Sensor Technology, Inc., www.futek.com/product, load cell, 1998-2016, Irvine, California.
Dino Accoto and Giorgio Carpino, Design and characterization of a noval . . . , Intech, Aug. 13, 2013, p. 1-12, vol. 10, Roma, Italy.
Fabrizio Sergi, Design and characterization of a compact . . . , IEEE, Jun. 24, 2012, p. 1931-1936; Roma, Italy.
PCT Search Report, written opinion of the international searching authority, pct/us16/21305, Apr. 21, 2016, p. 1-13, commissioner of patents, Alexandria, Virginia 22313.

* cited by examiner

Series Elastic Torque Sensor Exploded View

TIME 1

1. Spring output position sensor monitors torsion spring output side
2. Does sensor detect movement? Y/N Yes 3. Intelligent motor controller calculates amount of movement (degree of rotation of deflection)
4. Motor controller calculates force based on the amount of movement and spring constant
5. Has spring input position sensor detected movement of torsion spring input side? Y/N
6. If yes, motor controller calculates force based on amount of movement and spring constant
7. Motor controller reconciles calculated force on output side with calculated force on input side.

TIME 2

8. Has spring output position sensor detected additional movement of torsion spring output side? Y/N No 9. Motor controller recalculates force based on static degree of rotation of deflection and spring constant.

If yes, repeat steps 3 through 7

Figure 6

1. Monitor spring input position sensor (Assume no load on input side)
2. Does torsion spring input side move? Y/N Yes 3. Motor controller computes amount of movement (degrees of rotation of deflection)
4. Motor controller computes force on torsion spring output side using calculated amount of movement of input side and spring constant
5. Does torsion spring output side move? Y/N Yes 6. Motor controller computes amount of movement
7. Motor controller reconciles calculated force from torsion spring input side with calculated force from torsion spring output movement
8. Motor controller computes off set (counterbalance) force for torsion spring input side

Figure 7

Torque control is one application of the sensor, and the exercise devise is a use Of that application. Torque control using the torque sensor looks like this:

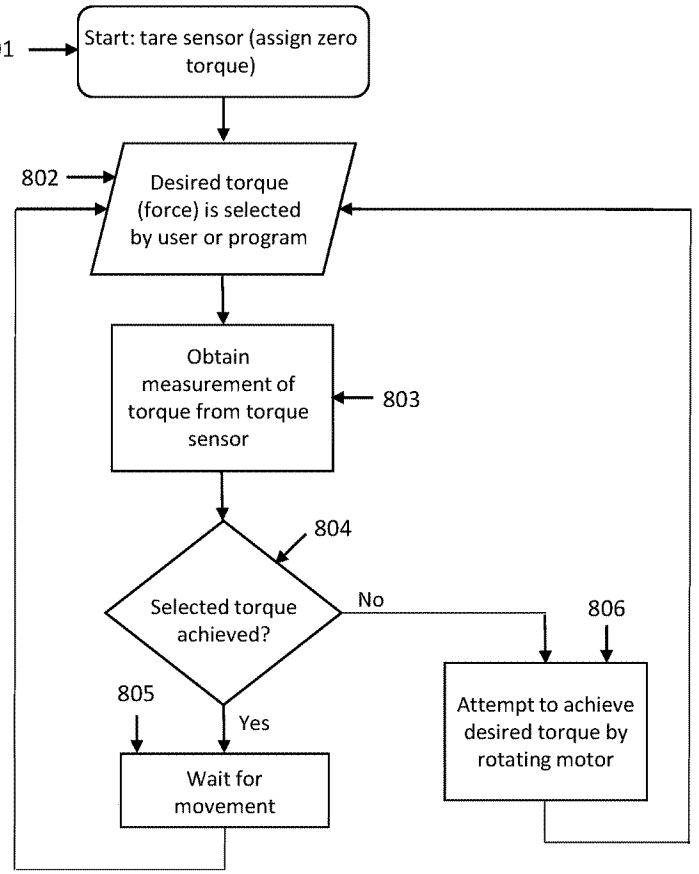

With torque control, the specific construction and operation of the torque sensor isn't important – the sensor is treated as a black box. For the exercise device, the construction of the torque sensor is important because of cost and accuracy

Figure 8

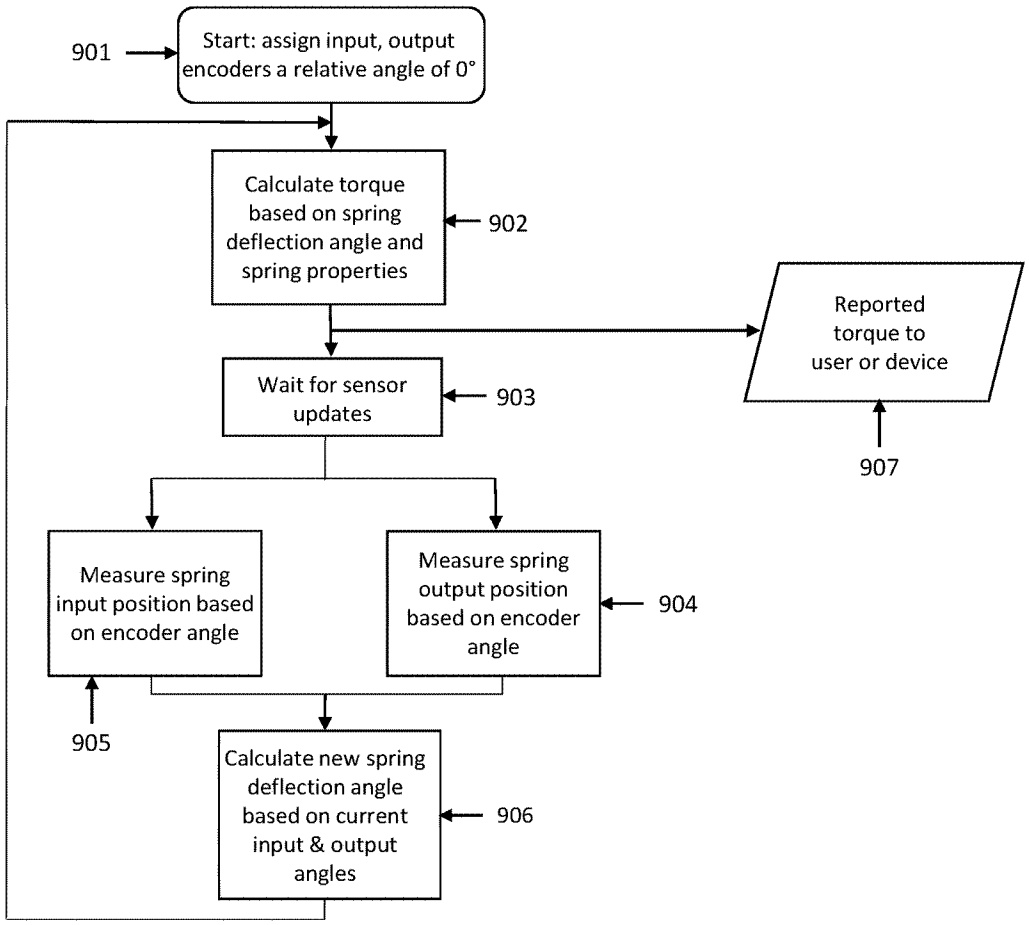

Figure 9

Position sensors can rotate 360° and do not report an absolute position, so the starting position is assumed to be 0

Given an input and output angle, the deflection of the spring is known; that information along with known spring properties can be used to calculate the torque or force applied to the spring New encoder data is read on a periodic basis Encoders read spring input and output position from the same fixed reference point so that relative movement can be obtained.

SERIES ELASTIC MOTORIZED EXERCISE MACHINE

RELATED APPLICATIONS

This Disclosure claims priority to Provisional Application entitled Elastic Torque Sensor for Planar Torsion Spring filed Oct. 9, 2014 as application Ser. No. 62/061,815 and Concentric Arc Spline Rotational Spring filed Jan. 1, 2015 as application Ser. No. 62/099,191. These provisional applications are incorporated by reference herein in their entirety.

FIELD OF USE

This disclosure pertains to the field of exercise machine apparatus for isokinetic, isotonic, and isometric exercises.

BACKGROUND OF DISCLOSURE

Exercise machines are known. Many exercise machines utilize combinations of weight connected to a load transfer system by cables and pulleys. Others use cylindrical springs. Other apparatus utilizes the deformation of material such as steel rods to provide resistance. Other types utilize friction resistance.

Isotonic exercising. This is the exercise experienced by lifting of traditional weights. The weight remains constant regardless of the weight's position relative to the individual. This allows the individual to take advantage of the inertia of the moving weight through the horizontal position in performing an arm curl. Thus the force exerted by the individual dips as the weight moves from the bottom position (at the knees) to the waist. Momentum is created. The speed of the weight does not remain constant. Weights (Isotonic exercising) cannot change through position change. Therefore the weight does not achieve optimal strength profile.

Isokinetic. The apparatus moves a constant speed. The individual pushes or pulls against the apparatus and, in the case of the Applicant's apparatus, the individual's force is measured and recorded. The machine does all the moving at a constant speed. The force changes while the load transfer mechanism velocity remains constant.

Isometric. The load transfer mechanism is in a fixed position. The individual tries to move the mechanism. The mechanism does not move. In the Applicant's apparatus, the force applied to the stationary load transfer mechanism is sensed and recorded. This measurement is an important distinction between pressing or pulling against the stationary load transfer mechanism or other immovable object. The force changes while the load transfer mechanism position remaining constant.

Position dependent force control. The machine does not move at a constant speed. The apparatus is not controlling the speed of the apparatus. Velocity is controlled by the individual. Rather the apparatus rotational velocity is controlled to vary the resistance force in a controlled manner through the individual's range of motion. The apparatus maintains the desired force regardless of velocity. The machine may change the amount of force applied to the individual based on the position of the load transfer mechanism within the individual's range of motion.

For the purposes of this application, "force," "torque," and "load" are used interchangeably to describe the forces applied to the user of the apparatus.

SUMMARY OF DISCLOSURE

The instant disclosure teaches a combination of devices or components to create a novel exercise apparatus. Unlike many other exercise devices, the Applicant's disclosure creates a load that does not generate momentum, i.e., resistance to change in velocity. In the prior art, once the individual moves a weight, the moving weight is resistant to a change in speed. This makes continued lifting of the weight easier. The combination of weight (mass) and velocity at which the individual is moving the weights is momentum.

The Applicant's apparatus is unique in that it combines inertia free motion with other apparatus components including but not limited to novel torque sensors, series elastic actuator (herein after "series elastic actuator" or "SEA") and gear reducer. A series elastic actuator is defined to contain a motor, gear reducer, torsion spring, and position sensor(s). In one embodiment, the motor may be a servo motor. The inertia free movement of the apparatus means that the force generated by the apparatus (using the electric motor, gears, and rotational torsion spring) is independent of gravity. The force exerted by the device is independent of the position of the load experienced by the user.

It will be appreciated that inertia distorts the exercise experience. It distorts the load placed on an individual's muscles leading to a less efficient workout and an increase in injury potential. It is therefore advantageous to an efficient exercise session that the individual not experience inertia.

Further, the apparatus of the Applicant's disclosure allows the individual to engage in multiple exercise modes. The individual can practice isokinetic exercising. Isokinetic exercise involves the exercise machine providing resistance to the movement of the individual. The individual can also practice isotonic exercise which involves muscle contraction in the presence of a constant load. Isometrics can also be practiced and involves the individual utilizing his/her muscles to press or pull against an immoveable object. The Applicant's disclosure also allows variable force profiles over the individual's range of motion. No existing exercise machine allows all four types of exercise modes to be performed.

The exercise machine of the Applicant's disclosure utilizes a torque sensor. The torque sensor comprises multiple components. Included is a circular torsion spring. The circular torsion spring comprises an outer ring and an inner ring. The inner and outer rings are concentric. The inner and outer rings are connected by one or more splines.

The torque sensor also includes a position measuring sensor to detect deflection between the outer ring (output side) and the inner ring (input side) of the torsion spring. The output side of the torsion spring is connected to the load transfer mechanism. The input side of the torsion spring is connected to the rotatable shaft of a motor through a reduction gear. The apparatus detects deflection of the outer ring relative to the inner ring. The deflection can be caused by a load, e.g., an individual pulling on a bar connected by belts or similar devices in communication with the torsion spring.

The torque measuring sensor, detecting deflection of the torsion spring, signals a servo drive motor controller or microprocessor. In response to this signal, the motor controller may cause the motor to activate. This activation can turn or rotate the motor shaft and the reduction gear. The motor shaft may rotate at variable speeds as directed by the motor controller. The motor can be a servo motor. A servo drive can contain or be in communication with a microprocessor. This motor may be referred herein as an "intelligent servo drive." The motor shaft is in communication with the gear reducer which is in communication with the inner ring (input side) of the torsion spring. The rotation of the shaft, at a speed selected by the motor controller can offset the deflection of the torsion spring. The shaft can rotate in either a clockwise or counter clockwise direction.

The motor controller can contain embedded intelligence. The motor controller is programmable.

SUMMARY OF DRAWINGS

The accompanying drawings, which are incorporated in and constitute a part of the specification, illustrate preferred embodiments of the invention. These drawings, together with the general description of the disclosure given above and the detailed description of the preferred embodiments given below, serve to explain the principles of the disclosure.

FIG. 1 also illustrates an encoder 391 and reader 392 (shown in FIG. 3A) mounted to a rigid bracket 393. The encoder and reader are outside of the load path of the torque sensor. FIGS. 3 and 3A illustrate the series elastic torque sensor 302 comprising tow position sensors 312 and 313, encoders 391, 391A and readers 392, 392A for each position sensor 312, 313, gear reducer 303, servo motor 304, and intelligent motor controller 305. The location of the two sets of encoders 391, 391A and readers 392, 392A are shown by the dashed line box in FIG. 3 with an exploded, enlarged view in FIG. 3A. In the illustrated embodiment, the encoder 391 and reader 392 are mounted on the rigid bracket 393 outside the load path where the rigid bracket 393 is attached to the device base 306. FIG. 3A illustrates a detail of the edge of the series elastic torque sensor showing the edge of the sensor (disk) circumference of two position sensors 312, 313 in conjunction with two encoders 391, 391A and readers 392, 392A. As will be described in further detail below, in one embodiment an optical sensor (encoder) may be mounted on a rigid bracket independent of the rotational movement of the sensor disks or the torque load on the planar torsion spring. The encoder will shine a light beam across and through the sensor disk. The light beam will be detected by a light sensor (encoder receiver). When an opaque degree marking crosses the light path, the light sensor will detect an interruption in signal and will send an appropriate signal to a controller.

FIG. 3 illustrates an exploded view of additional components of the disclosure including the series elastic torque sensor, gear reducer, intelligent motor controller and servo motor. Illustrated is the continuous axis of rotation shared by all components including the spool. FIG. 3A illustrates an expanded view of a portion of the apparatus illustrated in FIG. 3. This expanded view illustrates the edge of two position sensors, the planar torsion spring and the encoder and reader. The position of the stationary encoder and reader is shown relative to the moveable position sensors.

FIG. 6 illustrates a logic flow diagram of the operation of the encoder in conjunction with the movement of the output sensor.

FIG. 7 illustrates an encoder monitoring the sensor disk attached to the input side of the planar torsion spring.

FIG. 8 illustrates a logic flow chart for torque control utilizing the optical encoder.

FIG. 9 illustrates a logic flow chart utilizing detected optical signals of movement of the input side of the planar torsion spring to compute torque force applied to the output side.

DETAILED DESCRIPTION OF DISCLOSURE

Figure 1:
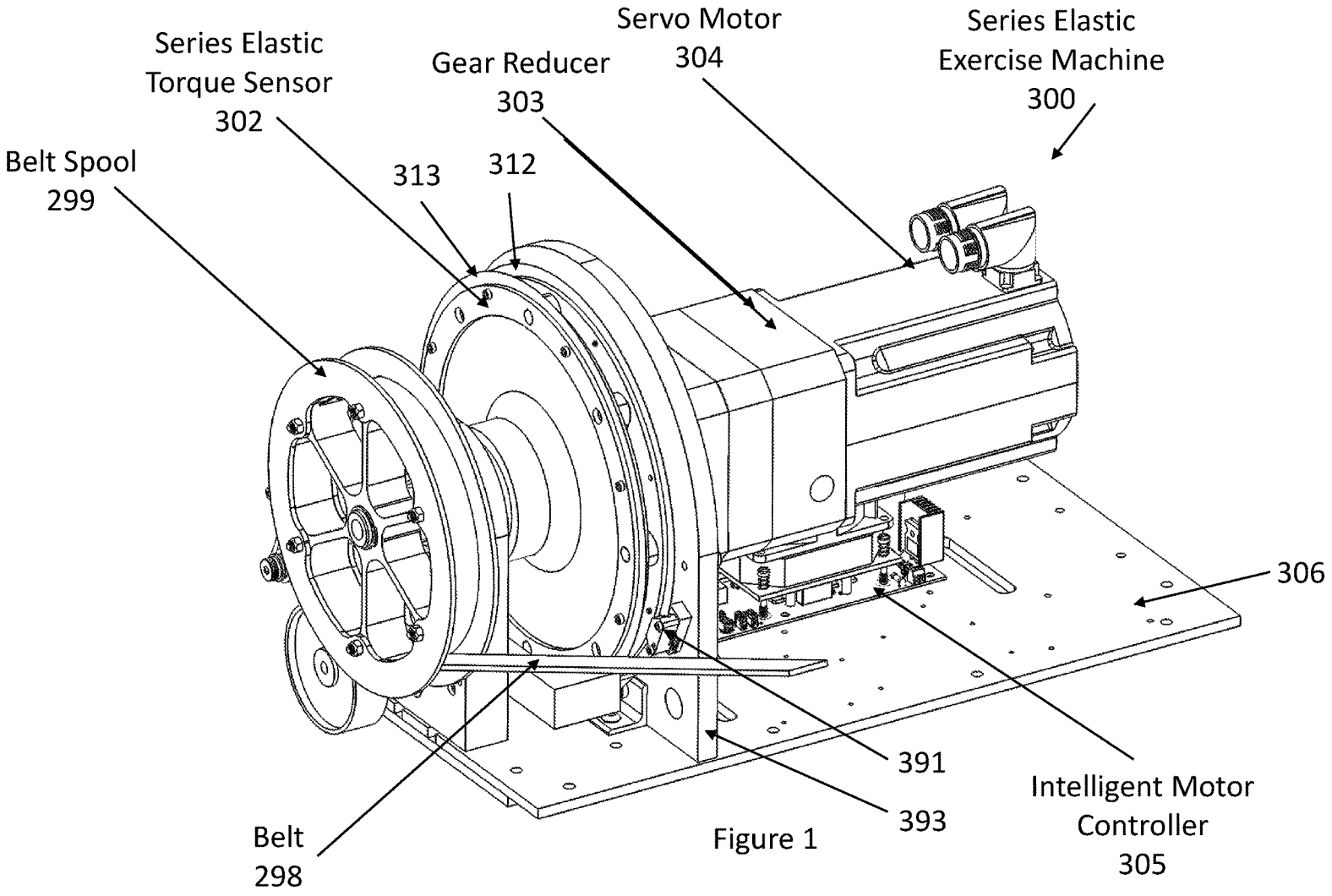
FIG. 1 illustrates a perspective of the Series Elastic Exercise Machine (apparatus) subject of the Applicant's disclosure. Illustrated is the belt spool 299 that is used in conjunction with a belt 298 which is part of a load transfer mechanism adapted for use by an individual. It will be appreciated that the load transfer mechanism can have multiple configurations, adopted to provide a different type of exercise.

The apparatus of the Applicant's disclosure is a Series Elastic Exercise Machine 300 illustrated in FIG. 1. The apparatus includes, but is not limited to, a load transfer mechanism including a belt spool 299 adapted to allow an individual to move the apparatus; a series elastic torque sensor 302 including a torsion spring and position sensor disks312, 313; a programmable (intelligent) motor controller 305; and a gear reducer 303 and a motor 304. The motor may be a servo motor. The components of the apparatus can be mounted on a base 306.

The apparatus can vary the load profile throughout the range of motion utilized by the individual (through the load transfer mechanism). This pertains to the relationship between ROM (range of motion) and force. As the load changes in position relative to the user (due to the user's movement of the load) the amount of force required of the individual to be used to further move the load can automatically change. Stated differently, the relationship to the amount of required force relative to the position of the load creates a load profile. It will be appreciated that a constant load through the individual's ROM constitutes one of many types of load profiles.

The apparatus of this disclosure is a force or velocity controllable device using a variable speed electric servo motor (having a rotating shaft), gear reduction component, torque sensor, load transfer mechanism (including a pulley or spool, belt or cable), and motor controller (having programmable embedded electronics). One function of the apparatus is to provide force for the purpose of exercise; specifically strength training. Unlike weights, the programmability of the motor controller allows the amount of force (imparted by the motor through the gear component upon the individual) to be adjusted during a workout.

In Isokinetic training, the load mechanism moves a constant speed. The user applies resistive force against the moving load mechanism. The user's force is measured by the apparatus. The torque of the motor increases as the user resists the movement. This increase in motor force maintains constant motion of the load mechanism.

The disclosure includes the capability to use a series elastic actuator 300 (the custom design torque sensor and planar torsion spring coupled with a gear reducer and electric motor) to control the force applied through the load transfer mechanism (comprising in part the belt 298 and belt spool 299).

Load Transfer Mechanism

Figure 2:
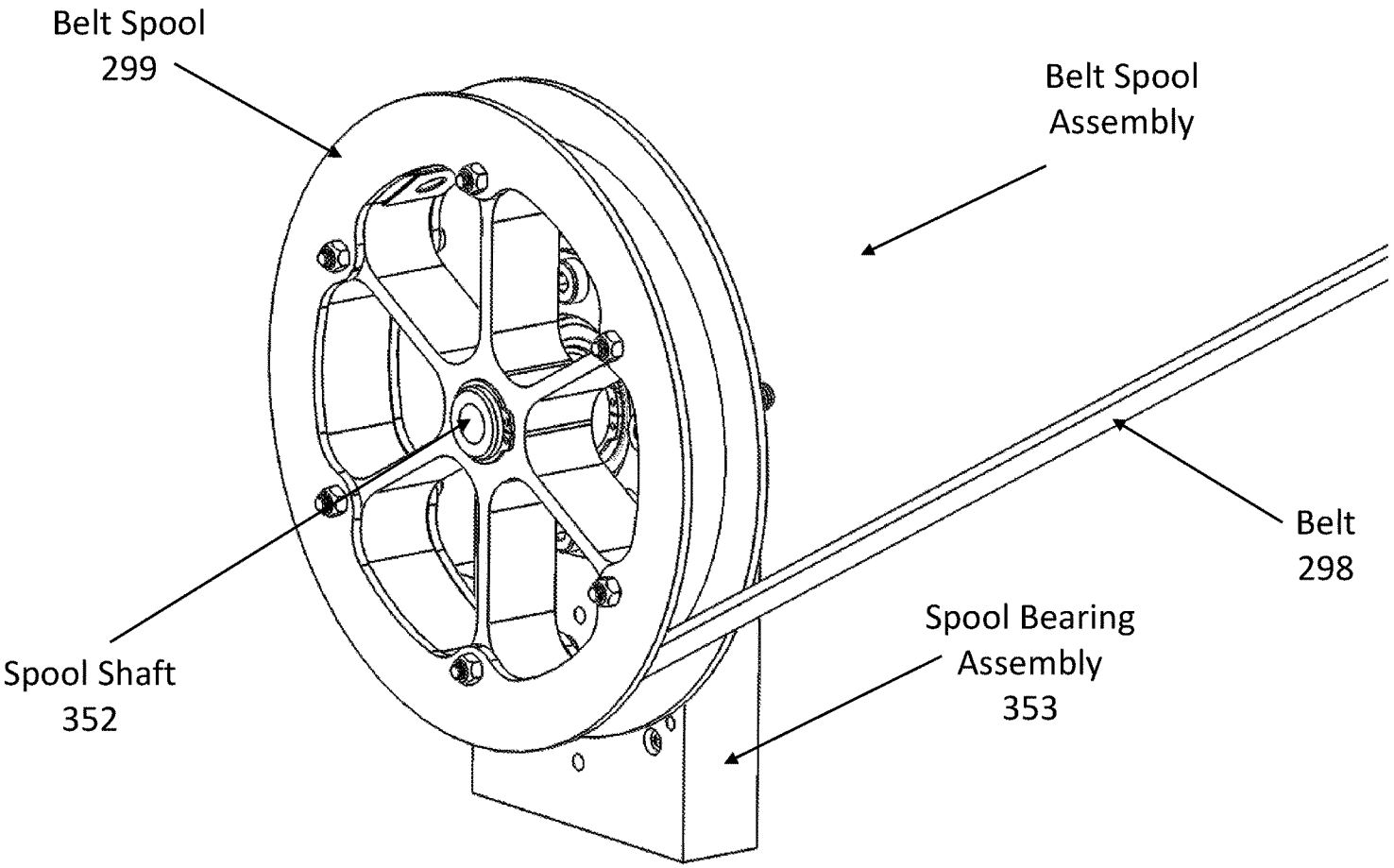
FIG. 2 illustrates a detail of the belt spool assembly, a component of the load transfer mechanism.

The disclosure comprises a load transfer mechanism adapted to be utilized by an individual to exert force or strength on the machine subject of the disclosure. Components of the load transfer mechanism, including the rotating belt spool 299, spool shaft 352, and rotating spool bearing assembly 353 are disclosed in FIG. 2. The load transfer mechanism (hereinafter "load transfer mechanism") contains the belt 298, rotating belt sppol 299, spool shaft 352, rotating spool bearing assembly 353 and componenets adapted to be grasped by the individual including but not limited to a belt, cable, rope, chain or similar device to transfer the load to a spool. It will be appreciated that the belt component, etc. is attached to the belt spool 299 and to the bar or handgrips (not shown). The spool shaft 352 rotates on the same axis of orientation 310 shown in FIG. 3. Also illustrated is the spool bearing assembly 353 that allows the spool to easily rotate under load.

The disclosure comprises a load transfer mechanism adapted to be utilized by an individual to exert force or strength on the machine subject of the disclosure.

Series Elastic Torque Sensor

Figure 3:
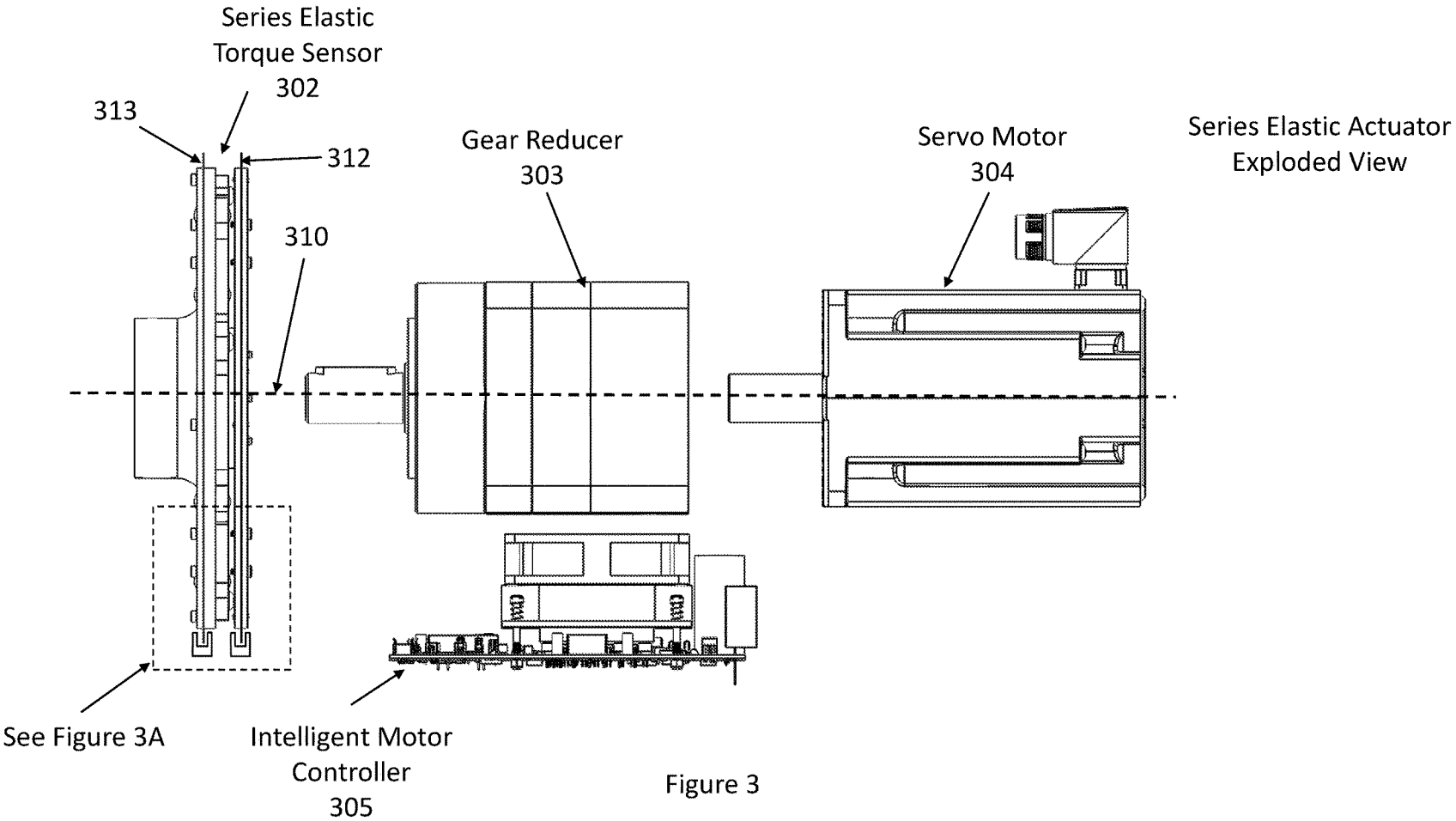
Figure 3A:
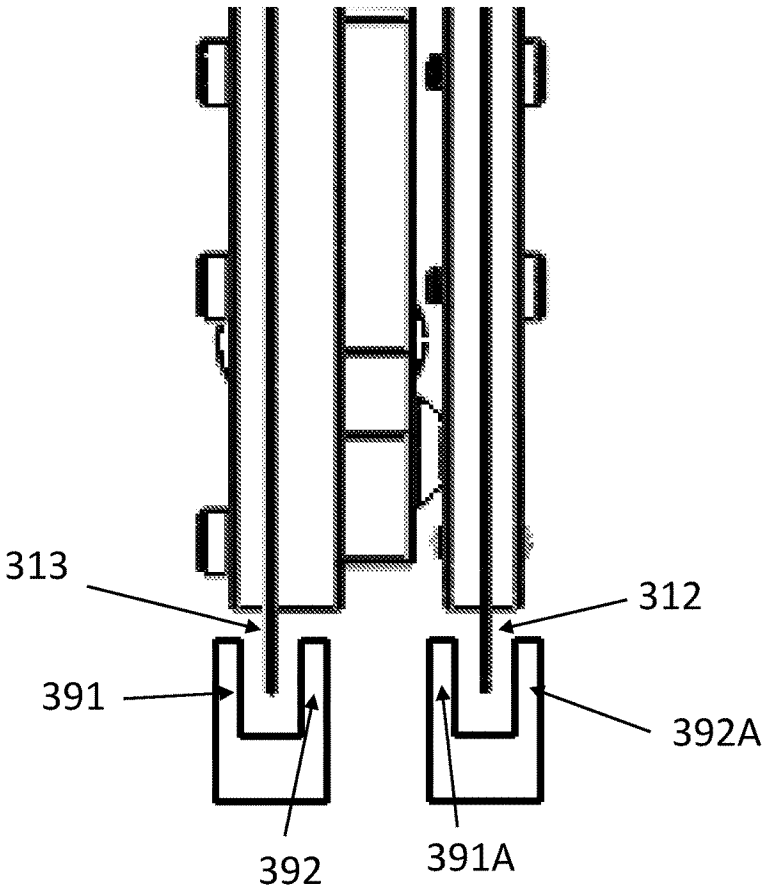
As shown in FIG. 3A and discussed further in detail below, it will be appreciated that the edge (outer circumference) of the position sensor 312 passes between the encoder 391A and the reader 392A. Further.

FIG. 3 illustrates a series elastic torque sensor 302. The torque sensor components are in communication with the Load Transfer Mechanism 299. These components share the same axis of rotation 310. The torque sensor 302 (hereinafter "series elastic torque sensor" or "torque sensor" contains an axis of rotation shared with spool of the load transfer mechanism, reducing gear and motor. The series elastic torque sensor also contains at least one position sensor in communication with an intelligent motor controller and a planar torsion spring. (See FIG. 4)

The inner and outer rings of the torsion spring are connected by one or more splines 415. In the embodiment shown in FIG. 3, there are three splines having concentric shapes substantially parallel to the outer diameter of the inner ring. The outer ring (output side) may rotate relative to the inner ring (input side) and vice versa in response to torque force.

The inner concentric ring (input side) may have a circular opening dimensioned to fit around the outer circumference of a rotating motor shaft or gear reducer. In one embodiment, the motor shaft and motor may have the same axis of orientation as the opening of the torsion spring. In other embodiments, the motor can be mounted at an angle to the opening of the torsion shaft. This may be advantageous for reducing space requirements.

The torsion spring 411 may be considered a component of the series elastic torque sensor. Elastic is used here to disclose that the deflection of the torsion spring (outer or inner ring) is measured.

This disclosure teaches a novel method of measuring the rotational degree of deflection between the output side and the input side of the torsion spring. The disclosure utilizes two spring position sensors 312, 313 (torque sensor disks). See FIG. 4. It utilizes flat circumferential plates or disks attached alternatively to the inner ring of the torsion spring or the outer ring. In one embodiment, each spring position sensor comprises a disk containing equidistant marks around the circumference of the disk. These can be tick marks. The marking designate degrees or partial degrees of the circumference. There are, of course, 360° in the circumference of each circle. These marks may alternatively be holes or apertures in the disk edge, notches in the disk edge or opaque markings on an otherwise clear disk. In another embodiment, the disk can have electromagnetic markings along the circumference.

The series elastic torque sensor has components that measure the movement of the circumferential markings on a first and second disk. This may be a light beam emitted from a component on one side of the first disk and a light receptor located on the opposite side of the first disk. The light receptor can record a signal or the receipt of light through the clear disk or through the teeth of the serrated edged disk. It will be appreciated that the light signal will be interrupted by the light beam being blocked by the opaque markers or the solid teeth of the serrated edged disk. In another embodiment, the receptor can record an electromagnetic signal from the marking along the circumference of the disk.

Each spring position sensor is round and has a circumference. In one embodiment, the diameter of each sensor is larger than the diameter of the planar torsion spring). This expanded circumference provides greater resolution to the position sensor and encoder components. Each disk is marked along or proximate to the circumference.

In one embodiment, the position sensor disks 302 can be translucent, e.g., clear plastic or polymer. The degree markings (or partial degree markings) can be opaque. An optical sensor (encoder) 391 may be mounted on a rigid bracket 393 independent of the rotational movement of the sensor disks or the torque load on the planar torsion spring. The encoder will shine a light beam across and through the sensor disk. The light beam will be detected by a light sensor (encoder receiver). When an opaque degree marking crosses the light path, the light sensor will detect an interruption in signal and will send an appropriate signal to a controller.

In another embodiment, the sensor disk can have notches or teeth placed on the circumference. The encoder would detect the interruptions in light caused by the notches or teeth rotating through the light path.

In yet another embodiment, markings can be placed on the circumference of the output side and the input side respectively. In one embodiment, the markers can be reflective and the encoder will detect the reflected light.

Looking at FIG. 1 an encoder set 391, 392 attached to a separate framework 393 and can, in one embodiment, transmit an optical signal upon the outer circumference of a spring output position sensor disk 312. The optical signal may be sensed by an optical reader on the opposite side 392A of the spring output position sensor disk. The optical reader senses movement of the output side of the torsion spring. This is detected by variations of the optical signal transmitted through the disk 313 circumference. As discussed more fully above the spring output position sensor disk may have opaque markers on the disk outer circumference. The markers, when positioned in front of the encoder 392 block the light normally received by the optical sensor or reader 392A. A second (opposite) configuration of encoder 391 and reader 392 is also used for the spring input position sensor. The position of each position sensor is utilized to determine the direction that torque force is being applied.

Each optical reader device (encoder receiver) will be in communication with the intelligent motor controller. The controller will utilize the signals received from the position sensor to compute the degrees of rotation of the output side or input side (or vice versa) of the torsion spring to compute thetorsion loads. It will be appreciated that the computation can be achieved upon activation of the apparatus. Therefore it is not necessary to first calibrate the degrees of rotation. See FIG. 9.

The encoder components of the spring position sensors 312, 313 do not rotate with the servo motor, gear reducer, torsion spring and position sensors.

Located between the first and second torque sensors is a planar torsion spring 411. The spring position sensors and torsion spring have the same axis of rotation.

Series Elastic Actuator

FIG. 3 also illustrates the intelligent motor controller 305 beneath the gear reducer 303. The intelligent motor controller 305 includes a microprocessor in communication with the servo motor 304 as well as a programmable user interface (not shown). One function of the intelligent motor controller is to direct motion (rotation) of the servo-motor.

It will be appreciated that the encoder sends a signal to the intelligent motor controller regarding the amount of torque being experienced by the torsion spring. This can be the result of force transferred through the load transfer mechanism. Each combinations of light emitters and light receptors at the series elastic torque sensor 302 can measure torque deflection of either the input ring or the output right. When deflection is detected, a signal is sent to the intelligent motor controller 305. The program of the motor controller can provide instructions to the servo motor 304.

It will also be appreciated that the torque transmitted through the load transfer mechanism causes the movement of the planer torsion spring, which in turn is detected by the torque sensor reader and communicated to the motor controller.

The load or force created by the rotating motor as modified by the gear reducer also is transferred through the series elastic torque sensor (including the torsion spring). Deflection of the input side of the torsion spring will cause a signal to the intelligent motor controller.

The operation of the motor controller (and the resulting controlled operation of the motor and gear reduction) can continuously vary the load profile throughout the range of motion utilized by the individual (through the load transfer mechanism). This pertains to the relationship between ROM (range of motion) and Force. As the load transfer device changes in position relative to the individual (due to the individual's movement of the load) the amount of force required of the individual to be used to further move the load transfer device changes. Stated differently, the relationship to the amount of required force relative to the position of the load creates a load profile.

FIG. 3 also illustrates that the servo motor 304, gear reducer 303, and series elastic torque sensor 302 share a common axis of rotation 310. It will be appreciated that this same axis of rotation extends through the spool shaft in FIG. 2.

Figure 4:
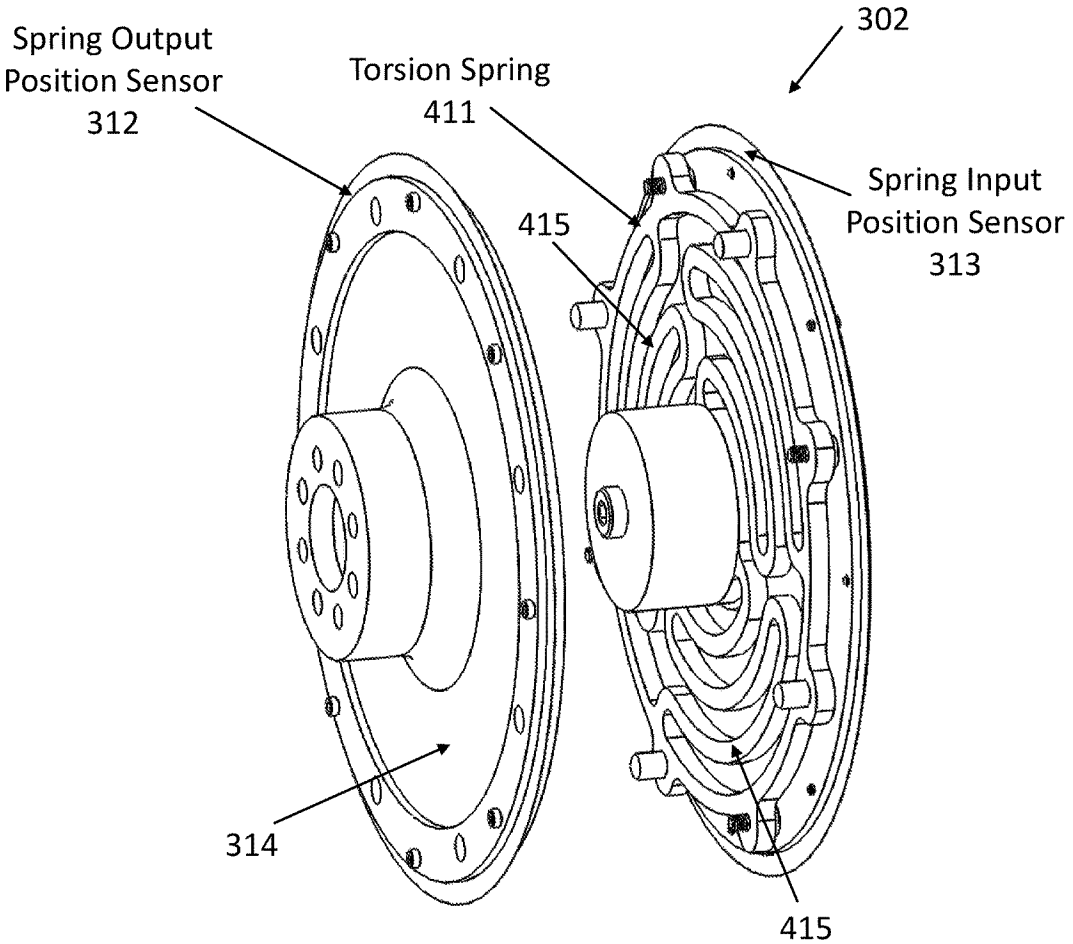
Figure 4 illustrates a perspective exploded view of the series elastic torque sensor. Illustrated is a circular mounting bracket containing a connection to the spool 299 illustrated in FIG. 1. Also illustrated are the position sensors 312, 313. Also shown is the outer circumferential edge of the spring output position sensor. In the embodiment shown, the sensor is transparent to light. Also shown is the torsion spring. The embodiment illustrated comprises three splines. Also shown is the spring input position sensor. In the embodiment shown, the sensor is also transparent to light. The diameters of both the input and output sensors extend past the diameter of the torsion spring. When assembled both the spring output sensor and the spring input sensor (position sensors) are positioned immediately adjacent to the torsion spring. The extended diameter of each position sensor can contain tick marks (not shown). Each position sensor can be utilized with optical encoders 391, 391A and separate optical readers 392, 392A that are mounted to a stationary element 393 to the device base 306 independent of the load path (shown in FIG. 1) and each pair are separately in optical communication with the spring output sensor and spring input sensor.

FIG. 4 illustrates a detailed view of the components of the series elastic torque sensor 302 Shown is the rotating plate 314 which is part of the load path. Attached is the spring output position sensor 312. In the embodiment illustrated, it comprises a transparent circular disk. The diameter of the disk is larger than the diameter of the torsion spring 411.

The torsion spring is illustrated having 3 splines 415. On the opposite side of the torsion spring from the spring output position sensor is the spring input position sensor 313. Also shown is the axis of rotation 310 extending from the servo motor (304 on FIG. 3) to the spool shaft (352 on FIG. 2).

Figure 5:
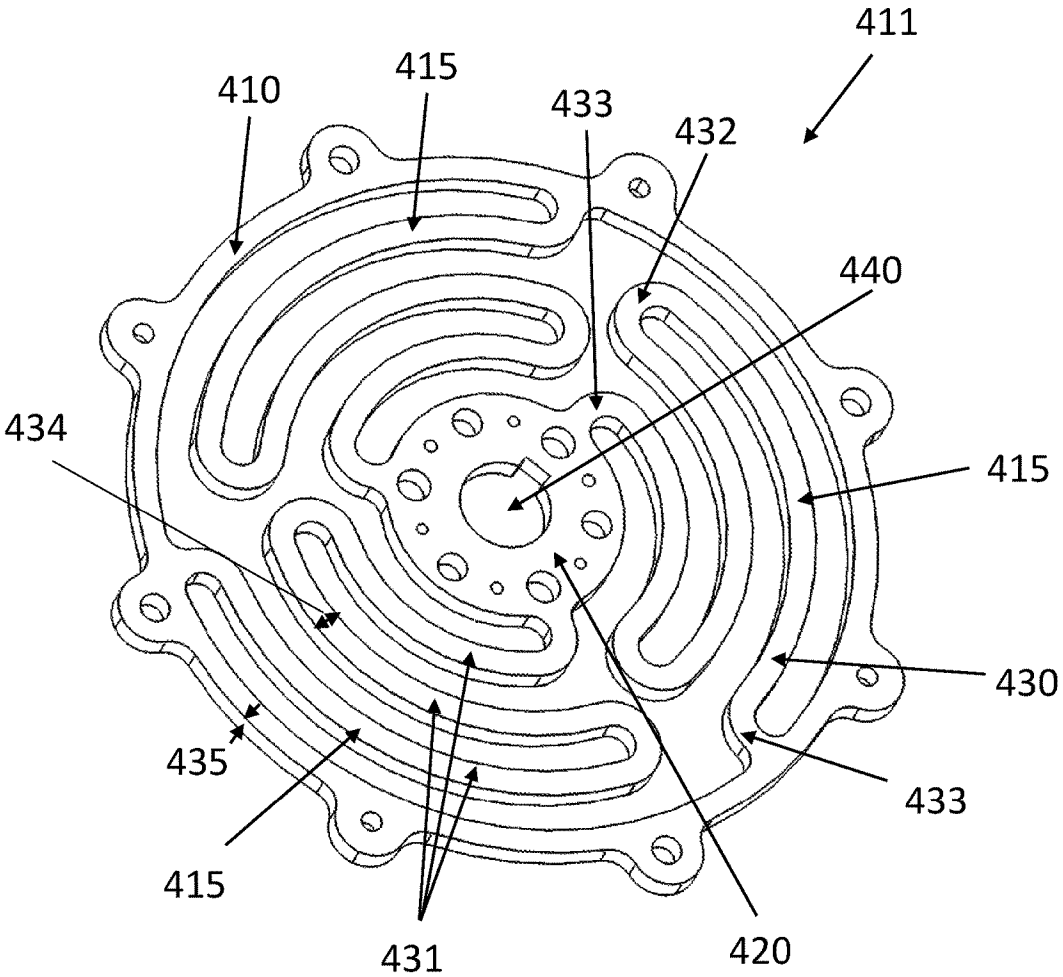
FIG. 5 illustrates a perspective view of the Applicant's novel elastic torsion spring which is part of the series elastic torque sensor. Illustrated in the output side, the concentric input side and three spline configured to maximize the spline length and circumferential positioning of the spline.

FIG. 5 illustrates an example of a planar torsion spring 411 utilized by the Applicants. The axis of rotation of the torsion spring is the same as the axis of rotation of the larger diameter position sensor. This axis of rotation is shared with the outer ring (the output side) 410 and the inner ring (the input side) 420. The axis of rotation passes through point 140 of the open center section of the spring.

The outer spring output is in communication with the load transfer component via a rotating plate 314 and described in the discussion of the motor controller. The torsion spring may be either of harmonic or planetary design. In one embodiment, the Applicant utilizes a unique planetary torsion spring design The Applicant's torsion spring utilizes 3 splines 415. The spring comprises a planar surface. The plane extends along the x and y axis. The spring has a radius in the x and y axis. The output side is concentric about the input side. The input side and output side share the same axis of rotation (See FIG. 2, items 140 and 310). The axis of rotation and longitudinal axis and spring thickness 435 are in the z direction. The width 434 of the spline is in the x and y axis.

The planar torsion spring comprises an inner ring 420 nested within a larger diameter outer ring 410. Stated differently, the inner ring is positioned concentrically within the diameter of the outer ring. The torsion spring has a planar shape.

The concentric inner and outer rings are joined together by one or more splines 415. The splines can form elongated concentric arcs 431 surrounding the exterior diameter of the inner ring. The spline arcs can be joined by curved elbows 432. The design of the spline can be opposite the design of a spoke between an outer rim and inner hub. It will be appreciated the spoke will extend from the inner hub in a radial straight direction to the outer rim. It will be appreciated that the elongated concentric arc (serpentine) of the Applicant's design permits the greater deflection of the spline with lower stress. The Applicant's design achieves this improvement by the longer load path formed of the elongated design of the concentric arc splines. It will be further appreciated that the spline can be deflected or deformed by the rotation of one ring relative to the other ring. Stated differently, by deformation of the splines, one ring may be rotated relative to the other ring.

With fewer splines, each spline can be designed longer to achieve a wider range of stiffness, but a lower maximum achievable stiffness. With fewer splines, each spline can be designed to have a longer extended path 430 between the inner ring and the outer ring. The thickness of the spline may be varied through the elongated length.

An alternate description of the torsion spring 411, a spring comprising fabricating a first outer ring 410, fabricating a second inner ring 420 which is positioned within the first outer ring and possessing a same axis of one or more splines 415 and extending the spline to a maximum length relative to the circumference between the first outer ring and second inner ring 431, fabricating the spline with the desired number concentric arcs between the inner circumference of the first outer ring and the outer circumference of the second inner ring and positioning the first outer ring, the second inner ring and the spline in the same plane. Each spline is connected by a tab 433 to the outer ring 410 and the inner ring 420.

The advantages of the Applicant's construction includes increased strength and flexure of the spring. With fewer splines, each spline can be designed longer to achieve a wider range of stiffness, but a lower maximum achievable stiffness. With fewer splines, each spline can be designed to have a longer extend path between the inner ring and the outer ring. The thickness of the spline may be varied through the elongated length.

The Applicant's planar torsion spring illustrated in FIG. 5 may be comprised of standard steel alloys e.g., 17-4PH stainless steel. This stainless steel utilized in the Applicant's design can achieve the same stiffness and strength of more expensive or more difficult to work with such as custom 465 stainless steel or maraging steel. Also, the spring illustrated in FIG. 5 can achieve a wider range of spring stiffness in other spring designs. The Applicant's torsion spring can be made of various materials including composite materials. The planar torsion spring is preferably made of metal such as steel. In some embodiments it can be made of maraging steel, a steel composite having a high yield strength.

Further, the Applicant's novel spring architecture reduces stress concentration by distributing the load more predictably and evenly. This means that the peak stress in the material is less with the new design given a size and stiffness target. The spring geometry (FIG. 5) illustrates a larger load path. It will be appreciated that the greater load path allows the stress created by spring deflection to be spread over a greater area, resulting in smaller and less consequential stress concentrations. The Applicant's spring design 411 shown in FIG. 5 allows the use of more standard alloys to get the same max load rating and stiffness.

It will of course be appreciated that the utility of the Applicant apparatus 300 subject of this disclosure is not dependent upon the Applicant's torsion spring design 411 illustrated in FIG. 5.

This disclosure incorporates by reference herein in its entirety the U.S. Pat. No. 8,291,788 of Chris Ihrke et al. entitled Rotary Series Elastic Actuator, issued Oct. 23, 2012. This disclosure also incorporates by reference provisional application entitled Elastic Torque Sensor for Planar Torsion Spring filed Oct. 9, 2014 as application Ser. No. 62/061,815 and provisional application entitled Concentric Arc Spline Rotational Spring filed Jan. 1, 2015 as application Ser. No. 62/099,191.

The apparatus 300 of this disclosure is a force or velocity controllable device using a variable speed electric motor (having a rotating shaft), gear reduction, torque sensor, spool, belt, and motor controller (having programmable embedded electronics). All are on the same axis of orientation 310. The main purpose of the apparatus is to provide force for the purpose of exercise; specifically strength training. Unlike weights, the programmability of the machine allows for the amount of force imparted on the user to be adjusted during a workout. The disclosure includes the capability to use a series elastic actuator (the custom design torque sensor and planar torsion spring) to control the force applied to the load transfer mechanism. This apparatus can maintain constant force being transferred to the user via the load transfer mechanism.

This disclosure incorporates by reference herein U.S. Pat. No. 5,993,356 issued Nov. 30, 1999 to Randle M. Houston et al. in its entirety.

Also taught by the Applicant in its disclosure is the novel use of a series elastic actuator (SEA). An SEA consists of the motor 304, gear reducer 303, torsion spring 411, and position sensor(s) 312. In one embodiment, the motor may be a servo motor. The components are connected as follows: motor attaches to gear reducer, gear reducer attaches to a torsion spring wherein two position sensors are respectively attached to the input and output rings of the torsion spring. Each position sensor 313 of the series elastic actuator can utilize separate encoders that signal the motor controller of movement of the torsion spring. The encoders are not in the load path. The motor controller 305 utilizes the signal from the light receptor component of the encoder to measure the deflection of the spring to calculate torque/force.

It will be appreciated that the prior art utilizes an electric motor. An SEA utilized by the Applicant allows direct control the torque seen on the output or input side of the torsion spring. This direct control of torque reduces the reflected inertia of the motor. This allows the apparatus of the Applicant to use a gear reducer 303. A gear reducer normally significantly magnifies the reflected inertia of the motor. (Motor inertia seen at the output of a gear reducer is equivalent to the motor inertia multiplied by the gear ratio squared).

There have been several problems with motorized strength equipment in the past. One problem has been that the control methods for the motor did not contemplate or adequately address the measurement of torque/force, resulting in the motor having relatively large reflected inertia. This large inertia causes problems unaddressed by U.S. Pat. No. 5,993,356 incorporated herein by reference in its entirety. This problem (large reflected inertia) also causes problems with other devices. Such problems included a non-smooth motion or difficulty in changing directions of movement of the load transfer mechanism.

The Applicant solves the problems of the preceding paragraph by using the series elastic torque sensor on the output side of the gear reducer, so that the output torque is controlled directly. This control removes the past practice of inferring the output torque. The disclosure also teaches controlling torque rather than velocity. Change in direction of movement (rotation) can occur without difficulty since the motor controller can selectively ignore velocity and direction.

It should be appreciated that the series elastic torque sensor performs all functions of commercially available torque sensors and is considerably less expensive than commercially available torque sensors. Commercial suppliers of torque sensors include Futek, and Interface T27. The Interface torque sensor T27 is listed at $9,045.00. The Futek torque sensor FSH02059 is listed at $3,630.00. The cost of the Applicant's series elastic torque is $300.00.

The Applicant's disclosure also teaches that it is advantageous to measure torque rather than linear force. As discussed above, the Applicant measures torque using a combination of a torque sensor (including a torsion spring) and a motor controller.

Linear force is commonly measured by using an inline load cell. Load cells are commercially available devices that measure stretching or compressive applied loads. One example of a commercially available load cell is available from Futek at www.futek.com/product. However load cells are expensive and subject to wear or deterioration in various ways. Load cells therefore require replacement. It should be noted that the load cell is part of the load chain and moves with the load transfer mechanism. This movement complicates maintaining an effective electrical connection to other components of the apparatus.

Another method of measuring torque is a motor electric current measurement device. As stated this can be a method of torque control. However this method has disadvantages including but not limited to noise and slow operation. A motor electric current measurement device is not suitable for the dynamic force control needs of the Applicant's apparatus.

The Applicant's adaption of a series elastic actuator (SEA) solved both problems. It is more reliable than the load cell based force measurements and more accurate than current sensor based measurements. It also allows smooth motion of the load transfer mechanism and the ability of the motor shaft to change directions.

As stated above a series elastic actuator consists of a motor, gear reduction, spring, and position sensor(s). The components are connected as follows: motor attaches to gear reducer, gear reducer attaches to spring, a position sensor or position sensors is/are used to measure the deflection of the spring to infer torque/force. The series elastic actuator is the force generator system of the Applicant's apparatus.

Another problem experienced in the prior art has resulted from using gear reducers. As stated previously, the inertia of the motor is dramatically increased when a gear reducer is used. This has resulted in gear reduction components not being used. This has resulted in devices having inferior control of force. Previously, devices utilizing gear reducers move too slowly to be suitable for exercise machines. (Geared devices have previously used only for isokinetic workouts). For example the device described in U.S. Pat. No. 5,993,356 does not utilize gear reduction components. This is attributed to the problems with force control in the presence of a large motor inertia. It will be appreciated that a motor driven machine that does not use a gear reduction component is either very limited in the ability to generate or control force or uses a very large motor. As explained below, the Applicant's apparatus utilizes a smaller motor.

In regard to comparative motor size, the Applicant's actuator (motor plus gear train has a mass of 11.5 kg. The actuator produces a peak torque of 154 Nm. An equivalent direct drive motor without a gear train that provides equivalent torque has a mass of 49 kg and is more expensive. Note the Applicant compared its motor/gear-train combination with a motor from the same manufacturer that provides the same peak torque as the Applicant's combination. The Applicant's motor is supplied by Kollmorgen, Radford, Va.

As discussed in the above paragraphs, the Applicant's apparatus utilizes a gear reducer. In the current embodiment, the ratio of the gear reducer is 10:1. The Applicant's use of a gear reducer amplifies the torque of the motor. This allows the Applicant to use a geared motor that can be 20-25% of the mass of an equivalent direct drive motor. The cost savings and mass reduction are substantial.

The Applicant's utilization of an SEA also achieves solution or mitigation of the following deficiencies experienced in the prior art. The deficiencies solved by the use of Series Elastic Actuator (SEA) include but are not limited to reflected inertia range of forces and speeds (power) that can be generated by a physically smaller motor. The SEA is more reliable than a load-cell based upon force measurements and more accurate sensor based measurements. The addition of the series elastic element (torsion spring) acts as a passive mechanical filter to smooth out high frequency vibration from the motor.

The Applicant's use of a series elastic actuator SEA significantly improves isotonic force control (constant muscle force) performance while still maintaining other modes of operation such as isokinetic (constant muscle and joint speed) and isometric (constant muscle and joint position). It also allows for variable force profiles.

Motor Controller

The motor controller of the Applicant's device is fully programmable making it independent of the kinematic relationships that exist in traditional weight machines. In other words, the force is completely independent of the position within the ROM. The motor controller (hereinafter entitled "intelligent motor controller") also contains embedded intelligence, e.g., microprocessor and intelligent servo drive, capable of operating algorithms of the motorized torque controllable exercise machine apparatus The intelligent motor controller can also collect data, including the strength utilized by the user. The data will be recorded on the user interface computer and then sending it over the Internet to the Applicant's servers. The data can be stored in the cloud. The microprocessor of the intelligent motor controller collects the data and sends it to the user interface computer, but in one embodiment, the intelligent motor controller does not store the data.

The apparatus 300 measures two positions to calculate torque. The two positions are measured by the spring output position sensor 312 and the spring input position sensor 313. The position sensors signal the motor controller 305 of the respective positions of the torsion spring input 420 and output 410. The intelligent motor controller utilizes changes in the respective positions to measure movement. Utilizing the spring constant, the torque (force) applied to the torsion spring is calculated. The device of the invention can record both force and position data.

FIG. 6 illustrates a logic flow diagram of the operation of the encoder in conjunction with the movement of the spring output position sensor. The encoder emits a signal at a rate of at least 10 kilohertz (10,000 cycles/sec). In one embodiment the signal is a pulse of light. The light pulse encoder monitors the position of the output side (Step 1) of the torsion spring. In another embodiment, the light source is continuous. If the optical receiver of the encoder detects a change in signal, either an interruption of the light signal received by the light receiver or receipt of a light source, the optic receiver of the encoder detects rotational movement of the output side. A signal will be sent to the computer processor of the intelligent motor controller (Step 2).

The number of light signal interruptions can be detected by the encoder optic receiver and counted by the motor controller (Step 3). The number of interruptions correlates to the number of tick marks on the circumference of the sensor disk attached to the output side. The number of ticks correlates to the distance of the circumference traversing across the encoder optic receiver. This correlates to the number of degrees of the arc segment. The length of the arc (angular position) is calculated by the computer processor of the motor controller. Knowing the spring constant, the amount of force experienced by the output side can be calculated (Step 4). The motor controller can send a responsive signal to the motor to generate force.

Simultaneously, a separate optic output component of the encoder and the encoder optic receiver monitors the input side of the torsion spring (Step 5). If movement is detected, the receiver submits a signal of the number of light interruptions (or light reflections if reflective markers are used) to the motor controller and the processor calculates the angular position and the force based upon the amount of movement and spring constant (Step 6). The intelligent motor controller can send a responsive signal to the motor.

The angular positions of both the output 410 and input side 420 of the torsion spring 411 are measured independently by spring input position sensor 313 and the spring output position sensor 312. The two angles (angular position of the input and output side of the torsion spring) are differenced and multiplied by the spring constant. The result of this calculation gives torque. The torque is then used at multiple kilohertz as feedback for a torque controller. This computation is performed by the intelligent motor controller 305 that contains a computer processor.

The intelligent motor controller can compare the calculated measurements of force on the output side and on the input side of the torsion spring. (Step 7)

The process is repeated for the next time interval. In the preferred embodiment, the time interval is at least $1/1\times10^{-5}$ second. (Step 8) If movement is detected, the movement is measured from the previous read position (Step 3). The force is calculated based upon the movement to the new position. (Step 9) Steps 3 through 7 are repeated.

FIG. 6 illustrates another embodiment of the disclosure. Here, an encoder monitors the sensor disk attached to the input side of the planar torsion spring. (Step 1). The sensor detects whether the input side moves (Step 2).

In a preferred embodiment, an encoder transmits a light signal through the sensor disk attached to the input side of the planar torsional spring. The light is transmitted through the translucent disk to an encoder receiver on the opposite side of the disk. As discussed previously, the circumference of the disk is marked with opaque tick marks. These marks interrupt the light signal as the input side moves through the light signal. The interruptions are detected by the encoder receiver. The receiver transmits a signal of the interruption to the computer processor. The computer processor can calculate the distance rotated by the disk.

In step 3 the computer processor computes the rotational movement based upon the signals received from the encoder receiver. Using the known spring constant, the computer processor calculates the force experienced by the input side (Step 4). Simultaneously, signals from the encoder monitoring the sensor disk attached to the output side can be used by the computer processor to ascertain whether the output side has moved (Step 5).

If movement is detected, the amount of rotation is calculated by the computer processor based upon the signals received from the encoder receiver (Step 6). The amount of force experienced on the output side can be calculated based upon the amount of deflection and the spring constant. This computed force can be reconciled with the value computed in Step 4 above.

In an embodiment, the computer processor can compute the amount of offset force that could be generated by a torque force generator (e.g. motor).

It will be appreciated that the spring output/input position sensors (encoder sensors), are not affixed to the planar torsion spring. These sensors, in communication with the computer processor or microprocessor of the intelligent motor controller, are independently mounted to the apparatus and are not in the load path experienced by the output side or input side of the torsion spring.

Alternate sensor mechanisms can include a resolver, i.e., an analog encoder that converts an angle into a voltage level that can be read by an analog digital converter (ADC), or an Absolute Position Sensor (APS) which provides an exact angle based on a fixed zero point. In one embodiment, the sensor utilizes an incremental encoder. The incremental encoder requires a startup step of positioning the output and input sides each time the spring is activated.

As stated the apparatus of the Applicant's disclosure, the apparatus contains an intelligent motor controller.

FIG. 7 illustrates a logic flow diagram for utilizing detected movement of the spring position sensor disks by the encoder and transmission of signals to the programmable computer processor or microprocessor of the intelligent motor controller for calculation of torque.

FIG. 8 illustrates a logic flow diagram utilizing detected optical signals of movement of the input side of the planar torsion spring to compute torque force applied to the output side. The computation of torque forces begins with starting a tare sensor (assign zero torque) 801, followed by selection of desired torque (force) by user or program 802. The next step is to obtain a measurement of torque from the torque sensor 803. The process queries whether the selected torque is achieved 804. If yes, then wait for movement 805 and return to step 802. If the selected torque has not been achieved, then attempt to achieve desired torque by rotating motor 806 and return to step 802. With torque control, the specific construction and operation of the torque sensor isn't important—the sensor is treated as a black box. For the exercise device, the construction of the torque sensor is important because of cost and accuracy so that's the advantage of our particular torque sensor.

FIG. 9 illustrates the use of the encoders to determine torsion spring torque. The process starts by assigning input/output encoders a relative angle of 0° 901. Next torque is calculated based on spring deflection angle and spring properties 902. Then wait for sensor updates 903 and measure spring input position based on encoder angle 905 and measure spring output position based on encoder angle 904. Then calculate new spring deflection angle based on current input and output angles 906. Return to step 902. Also at step 903, report calculated torque from step 902 to user or device. The encoders can rotate 360° and do not report an absolute position, so the starting position is assumed to be 0. Given an input and output angle, the deflection of the spring is known; that information along with known spring properties can be used to calculate the torque or force applied to the spring. New encoder data is read on a periodic basis. Encoders read spring input and output position from the same fixed reference point so that relative movement can be obtained.

This disclosure is to be construed as illustrative only and is for the purpose of teaching those skilled in the art the manner of carrying out the subject matter of the disclosure. It is to be understood that the forms of the subject matter of the disclosure herein shown and described are to be taken as the presently preferred embodiments. As already stated, various changes may be made in the shape, size and arrangement of components or adjustments made in the steps of the method without departing from the scope of this disclosure. For example, equivalent elements may be substituted for those illustrated and described herein and certain features of the disclosure maybe utilized independently of the use of other features, all as would be apparent to one skilled in the art after having the benefit of this disclosure.

While specific embodiments have been illustrated and described, numerous modifications are possible without departing from the spirit of the disclosure, and the scope of protection is only limited by the scope of the accompanying claims.

What we claim is:

1. A motorized controllable exercise machine comprising:

a motor;

an elastic torque sensor comprising at least one position sensor coupled to an outer ring or inner ring of a planar torsion spring, wherein the position sensor does not convey a load, and wherein the position sensor does not exits within a load path conveyed through the outer ring or inner ring of the planar torsion spring, and wherein the outer ring and inner ring of the planar torsion spring are connected by a plurality of structured deformable and elastic splines, at least one position sensor being configured to detect rotation or deflection between the outer ring and the inner ring;

a stationary sensor component mounted independent of the load path conveyed through the outer ring or inner ring of the planar torsion spring wherein the stationary sensor component is in communication with and utilizes at least one position sensor, the stationary sensor designates angular position or changes in angular position of either the outing ring or the inner ring of the planar torsion spring relative to the other ring of the planar torsion spring;

a motor controller, wherein at least one signal reader of the elastic torque sensor and the motor are in electrical communication with the motor controller such that the motor controller is configured to calculate force, speed, and position from signals received from the at least one signal reader and conveyed to the motor controller to control a force, speed, and position of the motor; and a load transfer mechanism configured to receive a user load responsive to exercise and to impact rotation or deflection of the outer ring or inner ring of the planar torsion spring relative to each other.

2. The motorized controllable exercise machine of claim 1, wherein the at least one signal reader is configured for detection of rotation or deflection between the outer ring and the inner ring and the signal reader sends a signal to the motor controller.

3. The motorized controllable exercise machine of claim 1, wherein the load transfer mechanism comprises a belt and a belt spool.

4. The motorized controllable exercise machine of claim 1, further comprising a gear reducer, wherein the gear reducer comprises a shaft having an axis of rotation passing through a center opening of the planar torsion spring.

5. The motorized controllable exercise machine of claim 4, wherein the motor comprises a shaft coupled to the gear reducer.

6. The motorized controllable exercise machine system of claim 5, wherein the motor controller controls a speed of rotation of the motor shaft in response to an input received by the motor controller from the signal reader of the elastic torque sensor.

7. The motorized controllable exercise machine system of claim 1, wherein signals from the signal reader of the elastic torque sensor are input to the motor controller to control the motor.

8. The motorized controllable exercise machine of claim 1, wherein the machine is adapted for a user to perform isokinetic exercises.

9. The motorized controllable exercise machine of claim 1, wherein the machine is adapted for a user to perform isotonic exercises.

10. The motorized controllable exercise machine of claim 1, wherein the machine is adapted for a user to perform isometric exercises.

11. The motorized controllable exercise machine of claim 1, further comprising a user interface.

12. A motorized controllable exercise machine comprising:

a motor;

an elastic torque sensor comprising a planar torsion spring, wherein the planar torsion spring has an outer ring and inner ring connected by one or more structured deformable and elastic splines and the outer ring, inner ring and splines are configured to convey load and comprises a load path, at least one stationary sensor component positioned outside the load path which is conveyed and comprised by the planar torsion spring and the stationary sensor component being configured with a position sensor to use a signal reader of the stationary sensor component to detect rotation or deflection between the outer ring and the inner ring;

at least one position sensor attached to either the inner ring or outer ring of the torsion spring wherein the position sensor is outside the load path and does not convey a load of the torsion spring;

a motor controller, wherein the one signal reader and motor are in electrical communication with the motor controller such that the motor controller is configured to calculate force, speed, and motor position utilizing signals received from the signal reader;

and a load transfer mechanism coupled to the elastic torque sensor wherein the load transfer mechanism is configured to receive a user load responsive to user movement and the load transfer mechanism imparts rotation or deflection of the outer ring or inner ring of the planar torsion spring relative to each other.

13. The motorized controllable exercise machine of claim 12 wherein the load transfer mechanism comprises a belt and a belt spool.

14. The motorized controllable exercise machine of claim 12 wherein the planar torsion spring comprises one or more concentric arc splines having a serpentine shape.

15. The motorized controllable exercise machine of claim 12 further comprising a user interface.

16. The motorized controllable exercise machine of claim 12 further comprising a gear reducer including a shaft having an axis of rotation passing through an opening of the planar torsion spring.

17. The motorized controllable exercise machine of claim 16 wherein the motor comprises a shaft coupled to the gear reducer.

18. The motorized controllable exercise machine system of claim 17 wherein the motor controller controls a speed of rotation of the motor shaft in response to an input received by the motor controller from the elastic torque sensor.

19. A method of producing variable exercise loads in an exercise machine comprising the steps of:

providing an exercise machine comprising the following:

a motor;

an elastic torque sensor comprising at least one position sensor coupled to a planar torsion spring, wherein the planar torsion spring has an outer ring and inner ring connected by a plurality of structured deformable and elastic splines, at least one position sensor being outside a load path experienced by the planar torsion spring and configured to detect rotation or deflection between the outer ring and the inner ring;

a motor controller, wherein at least one reader is configured with a position sensor and motor are in electrical signal communication with the motor controller such that the motor controller is configured to calculate force, speed, and position and to control a force, speed, and position of the motor; and using a load transfer mechanism that transfers a user load to the torsion spring and motor;

imparting the user load to the elastic torque sensor thereby rotating or deflecting the outer ring or inner ring of the planar torsion spring relative to the other ring; and transferring motor movement force to the load transfer mechanism.

* * * * *